United States Patent [19]

Zoltner

[11] Patent Number: 4,827,307

[45] Date of Patent: May 2, 1989

[54] TONER CARTRIDGE FOR USE IN AN ELECTROPHOTOGRAPHIC PRINTING MACHINE

[75] Inventor: John D. Zoltner, Rochester, N.Y.

[73] Assignee: Xerox Corporation, Stamford, Conn.

[21] Appl. No.: 682,870

[22] Filed: Dec. 18, 1984

[51] Int. Cl.[4] ..... G03G 15/08

[52] U.S. Cl. ..... 355/3 DD; 355/260; 206/633

[58] Field of Search ..... 355/3 DD, 14 D, 3 R; 222/DIG. 1, 325; 206/631, 633

[56] References Cited

U.S. PATENT DOCUMENTS

| | | | |
|---|---|---|---|
| 2,904,000 | 9/1959 | Fisher et al. | 118/637 |
| 2,954,116 | 9/1960 | Maso et al. | 206/633 X |
| 3,332,549 | 7/1967 | Ponell | 206/633 X |
| 3,339,807 | 9/1967 | Eichorn | 222/171 |
| 3,342,326 | 9/1967 | Zackheim | 206/633 X |
| 3,385,500 | 5/1968 | Lavander | 229/7 |
| 3,460,742 | 8/1969 | Langdon | 206/633 X |
| 3,618,826 | 11/1971 | Kangas | 206/633 X |
| 3,724,422 | 4/1973 | Latone et al. | 118/637 |
| 3,724,651 | 4/1973 | Link | 206/633 X |
| 3,897,900 | 8/1975 | Gorski et al. | 206/633 X |
| 4,125,985 | 11/1978 | Laske | 206/631 X |
| 4,478,512 | 10/1984 | Zoltner | 355/3 DD |

FOREIGN PATENT DOCUMENTS 59-53868 3/1984 Japan .

*Primary Examiner*—A. C. Prescott

*Attorney, Agent, or Firm*—H. Fleischer; J. E. Beck; R. Zibelli

[57] ABSTRACT

A toner cartridge for use in a copying machine for supplying fresh toner to the developer for the machine. The cartridge is formed with an elongated opening to permit discharge of toner when inverted. A removable flexible strip covers the opening and is detachably held to the cartridge by adhesive material. The pattern of the adhesive material is non-linear at the portions of the cartridge adjacent the ends of the opening so that upon an application of a pulling force upon the strip to detach the same, the resistance force is gradual.

4 Claims, 4 Drawing Sheets

TONER CARTRIDGE FOR USE IN AN ELECTROPHOTOGRAPHIC PRINTING MACHINE

This invention relates generally to an electrophotographic printing machine, and more particularly concerns a toner cartridge for discharging additional toner particles into the toner dispenser of the development system used in the printing machine.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. Generally, the developer material comprises toner particles adhering triboelectrically to carrier granules. The toner particles are attracted to the latent image from the carrier granules to form a powder image on the photoconductive member which is subsequently transferred to a copy sheet. Finally, the copy sheet is heated to permanently affix the powder image thereto in image configuration.

As the toner particles are depleted from the developer material, it is necessary to dispense additional toner particles into the developer mixture. In this way, the concentration of toner particles within the developer mixture is maintained substantially constant. To achieve this, electrophotographic printing machines frequently have dispensers which discharge toner particles into the development system. After a period of time, it is necessary to replenish the toner particles within the dispenser. When adding additional toner particles to the dispenser in the printing machine, any spillage results in contamination of the areas having the spilled toner particles thereon. The toner particles, being very finely ground, also become airborne carrying this contamination to other areas not immediately adjacent the development system. Furthermore, the spilled toner particles also have a tendency to cling to the operator's hands or to the surrounding environment. It is thus clear that the addition of toner particles into the printing machine is a dirty and messy job which frequently inadvertently spills on the operator's hands and clothing. It is, therefore, highly desirable to package the toner particles in a manner such that the contamination of both the operator and the printing machine is minimized.

Various approaches have been devised to improve toner cartridges used to furnish additional toner particles to the dispenser of the development system used in an electrophotographic printing machine.

In U.S. Pat. No. 2,904,000, Fisher et al discloses a toner magazine having a container consisting of an elongated, generally rectangular plastic box with the bottom wall thereof having a number of apertures therein. During storage and prior to actual use, the apertures are covered by a strip of plastic tape. The tape is removed just before the container is inserted for use in the magazine.

In U.S. Pat. No. 3,339,807, Eichorn describes a toner package having a cylindrical body with several openings therein. The openings are sealed by a tear strip or cover with a tab which is easily removable by hand before insertion into the dispensing apparatus of the printing machine. Toner particles are discharged from the toner package through the openings therein.

In U.S. Pat. No. 3,385,500, Lavander discloses a toner package consisting of a rectangular cardboard body. The bottom portion of the container defines a removable tear strip which extends along the bottom of the container. The strip includes a tab portion which extends beyond the length of the toner package. The tab portion has an opening therein which is gripped by a protruding portion of a slide. The toner package and the slide are then both placed into the toner dispenser along guide rails. The slide is then removed pulling the bottom strip from the toner package. This discharges the toner particles into the toner dispenser.

In U.S. Pat. No. 4,478,512, Zoltner discloses a toner cartridge having a tubular container formed with an elongated opening. Held onto the container and closing the opening is a removable sealing strip which is removed as the same is clipped into a toner dispenser by the operator.

In accordance with the present invention, there is provided an apparatus for storing a supply of marking particles therein. A cartridge defines a chamber for storing the marking particles, such as toner, therein. The cartridge has an elongated opening in the surface thereof for the discharge of the marking particles therefrom. A flexible sealing strip is removably secured to the container sealing the opening in the surface thereof to prevent the discharge of the marking particles therefrom. The flexible backing strip is applied as by adhesive material over the entire opening and beyond all edges thereof. The portion of the adhesive material at the ends of the opening is patterned so as not to be in a line perpendicular to the direction of pull of the stripping motion when the strip is removed so that the force necessary to start and end the strip removing motion is gradual. The pattern of adhesive material is such as to offer easy, graduated resistance to the pull force so as to avoid a sudden high peel force at the ends and subsequent "toner puff".

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
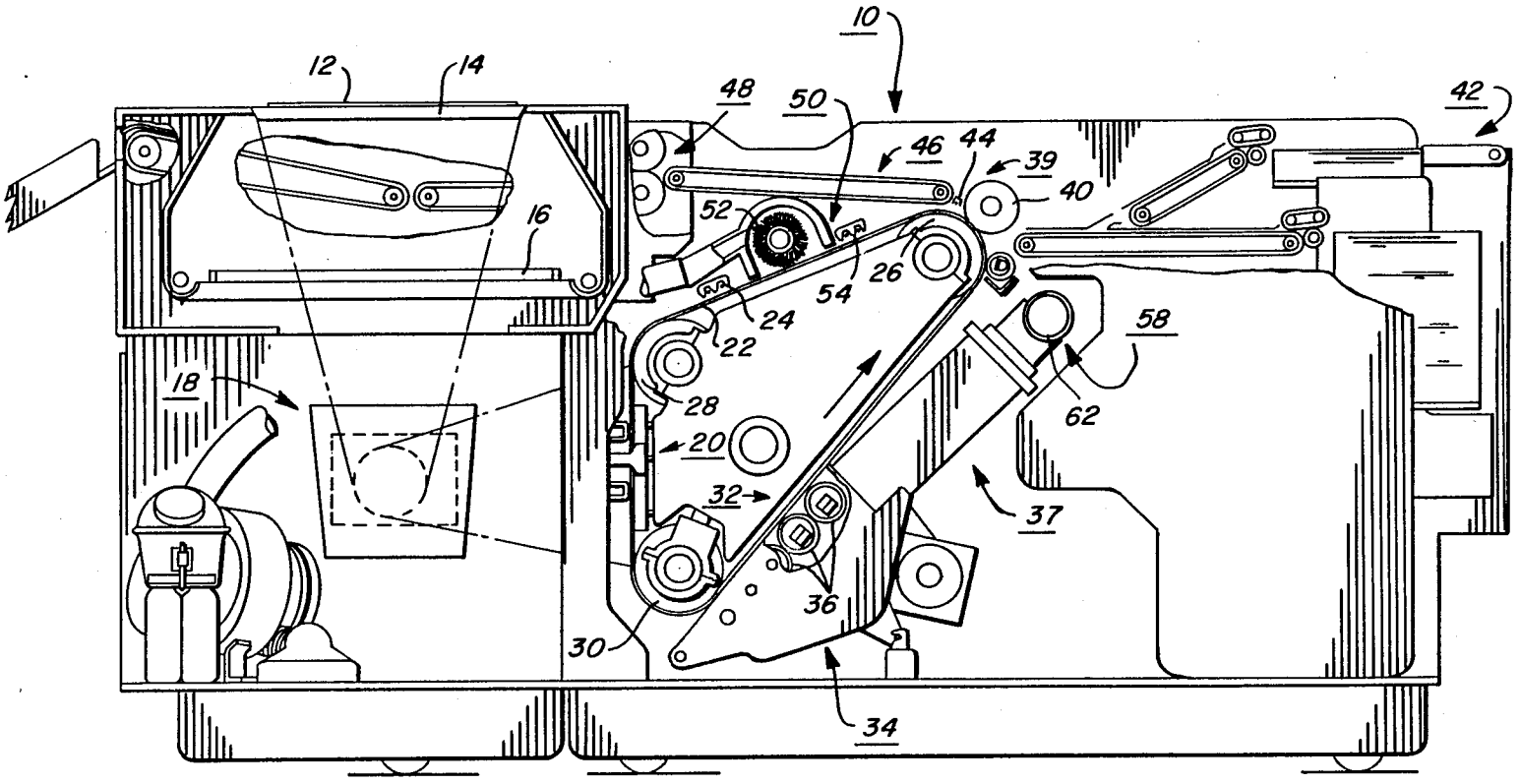
FIG. 1 is a schematic elevational view of an electrophotographic printing machine incorporating the features of the present invention therein.
Figure 2:
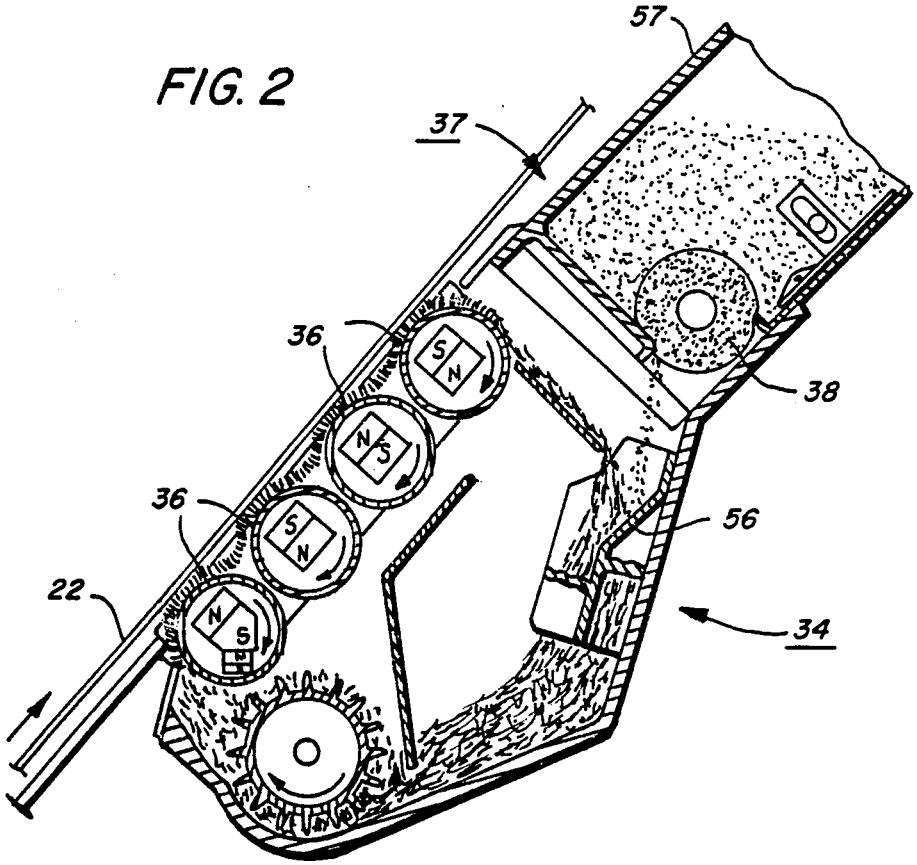
FIG. 2 is a elevational view showing the development system used in the FIG. 1 printing machine.

For a general understanding of an electrostatic processing system in which the invention may be incorporated, reference is made to FIG. 1. As in all electrostatic reproduction machines of the type illustrated, a light image of an original to be reproduced is projected onto the sensitized surface of a xerographic plate to form an electrostatic latent image thereon. Thereafter, the latent image is developed with an oppositely charged developing material comprising carrier beads and smaller toner particles triboelectrically adhering thereto to form a xerographic powder image corresponding to the latent image of the plate surface. The powder image is then electrostatically transferred to a support surface to which t may be fixed by a fusing device whereby the toner image is caused permanently to adhere to the support surface.

In the illustrated machine 10, an original 12 to be copied is placed upon a transparent support platen 14 fixedly arranged in an illumination assembly generally indicated by the reference numeral 16. While upon the platen, an illumination system flashes light rays upon the original, thereby producing image rays corresponding to the informational areas on the original. The image rays are projected by means of an optical system 18 to an exposure station 20 for exposing the photosensitive surface of a moving xerographic plate in the form of a flexible photoconductive belt 22. In moving in the direction indicated by the arrow, prior to reaching the exposure station 20, that portion of the belt being exposed would have been uniformly charged by a corona device 24 located at a belt run extending between belt supporting rollers 26 and 28. The exposure station extends between the roller 28 and a third support roller 30.

The exposure of the belt surface to the light image discharges the photoconductive layer in the areas struck by light, whereby a latent electrostatic image is produced on the belt in image configuration corresponding to the light image projected from the original on the supporting platen. As the belt surface continues is movement, the electrostatic image passes around the roller 30 and through the developing station 32 located at a third run of the belt in which there is positioned a developing apparatus or developer generally indicated by the reference numeral 34. The developing apparatus 34 comprises a plurality of magnetic brushes 36 which carry developing material to the adjacent surface of the upwardly moving inclined photoconductive belt 22. As the developing material is applied to the xerographic belt, toner particles in the development material are attracted electrostatically to the belt surface to form powder images. During the reproduction process, toner is periodically automatically dispensed into the developer 34 from a toner dispenser 37 via any conventional means such as a foam roller 38. Further details of the developer 34 are not necessary to understand and implement the present invention. Details of such a developer are adequately disclosed in U.S. Pat. No. 3,724,422, which is incorporated by reference herein.

The developed electrostatic image is transported by the belt 22 to a transfer station 39 located at a point of tangency on the belt as it moves around the roller 26 where a sheet of copy paper is moved in synchronism with the moving belt in order to accomplish transfer of the developed image. A transfer roller 40 at the transfer station is arranged on the frame of the machine to contact the non-transfer side of each sheet of copy paper as the latter is brought into transfer engagement with the belt 22. The roller 40 is electrically biased with sufficient voltage so that a developed image on the belt may be electrostatically transferred to the adjacent side of a sheet of paper as the same is brought into contact therewith.

Also provided is a suitable sheet transport mechanism adapted to transport sheets of paper seriatim from a paper handling mechanism generally indicated by the reference numeral 42 to the developed image on the belt as the same is carried around the roller 26. A programming device operatively connected to the mechanism 42 and to the illumination device, is effective to present a developed image at the transfer station 39 in timed sequence with the arrival of a sheet of paper.

As the sheet emerges from the transfer roller, it is influenced by a detacking corona discharge device 44 so as to lessen the electrostaic attraction between the sheet and the belt. The sheet is thereafter retained on the underside of a transport mechanism 46 by suitable means such as vacuum for movement into a fuser assembly generally indicated by the reference numeral 48 wherein the developed and transferred xerographic powder image on the sheet is permanently affixed thereto. After fusing, the finished copy is discharged from the apparatus at a suitable point for collection externally of the apparatus. The toner particles remaining as residue on the developed image, background particles, and those particles otherwise not transferred are carried by the belt 22 to a cleaning apparatus 50 positioned on the run of the belt between the rollers 26 and 28 adjacent to the charging device 24. The cleaning apparatus comprises a rotating brush 52 and a corona discharge device 54, for neutralizing charges remaining on the particles.

The developer apparatus includes a cross-mixing baffle 56 which mixes the fresh toner particles being discharged from dispenser 37 with the denuded carrier granules and unused developed material being returned to the chamber within the developer 34. The dispenser 37 includes a housing 57 for receiving a toner cartridge, indicated generally by the reference numeral 60. The foam roll 38 is disposed in the opening of the housing 57 to dispense toner particles therefrom.

In operation, toner cartridge 60 is inserted into housing 58 of the toner dispenser 37 and the roller 38 dispenses toner particles from housing 57 onto the mixing device 56. The device 56 mixes the freshly dispensed toner particles with the denuded carrier granules and unused developer material, and this mixture is then returned to the housing for the developer 34.

Figure 3:
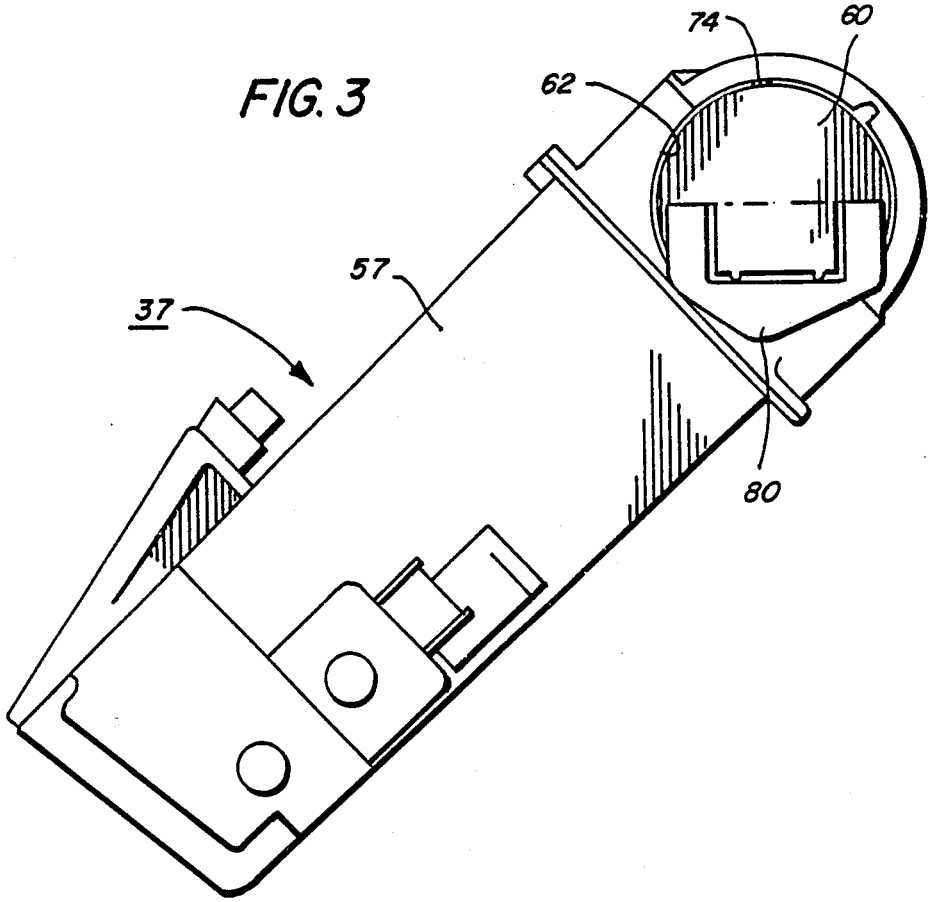
FIG. 3 is an elevational view of the toner dispenser to which the present invention is associated.

As shown in FIG. 3, the toner cartridge 60 is positioned with the opening 62 in the upper end of the dispenser 37 so as to be in communication with housing 57 for the discharge of the toner particles thereto. The toner cartridge 60 includes a container 64 having an opening 65 therein. The container 64 is tubular and defines an interior chamber 66 for storing the toner particles therein. A sealing strip 67 is adhesively secured to the container 64 over the opening 65 and has an adhesive coating **70*a* on the surface thereof in contact with the container 64 along a pattern 70*b***.

A key or protuberance 74 is integral with and extends upwardly from the container 64, and when the toner cartridge 60 is inserted in the housing 58, the key 74 mates with a slot therein preventing the rotary movement thereof.

As shown, the toner cartridge 64 has the opening 65 therein sealed with sealing strip 67. After the strip 67 is removed as by pulling by the operator, as will be described below, and the cartridge 64 has been inserted in the housing 57 with the opening 65 facing upwardly, the cartridge is rotated 180° in the direction of the arrow. This rotation, when completed, places the opening facing downwardly so that the chamber 66 within the cartridge is in communication with the interior of the housing 57. In this latter position, toner particles are discharged by gravity from the chamber 66 through the opening 65 and into the dispenser 37.

Figure 4:
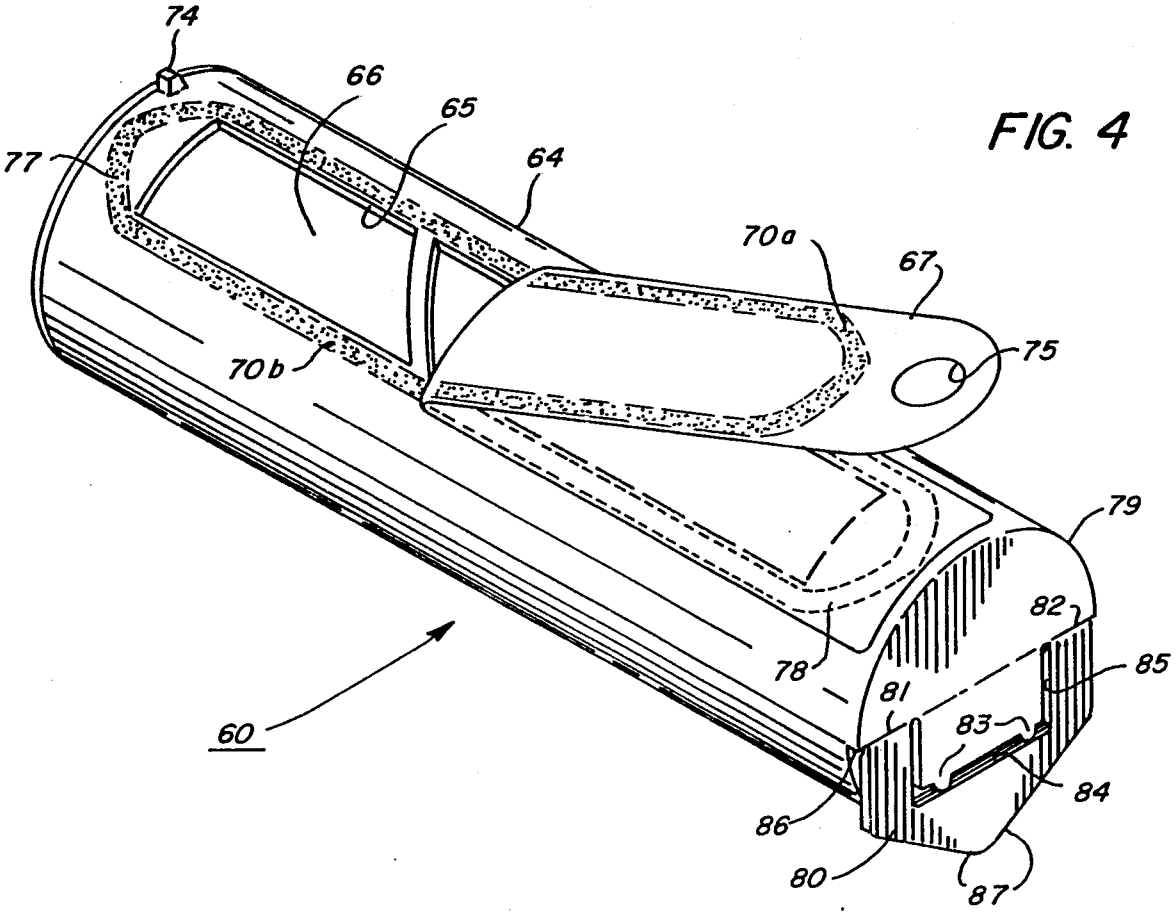
FIG. 4 is an isometric view illustrating the toner cartridge used in the FIG. 3 toner dispenser system.

As shown in FIG. 4, the strip 67 is continually folded upon itself as the operator, using an opening 75 formed at the pulling end for a handle, slowly removes the strip. In actual practice, the operator beings inserting the cartridge into the opening 62 as the strip 67 is initially pulled and holds onto the handle 75 as the cartridge is pushed deeper into the opening 62. In initiating the pulling force necessary to remove the strip, the end portion 77 of the pattern **70*b* for the adhesive material 70*a*, at the rear end of the cartridge, is the initial place of removal. Generally, this portion 77 of the adhesive pattern is linear and normal to the direction of pull. Because this layout portion 77 of the material provides a relatively large adhesive force against pulling, the operator must, in turn, exert a heavy, initial pulling force to start the removal of the strip 67. This sudden high peel force produces "toner puffs" resulting from jerking of the toner cartridge by the operator. Such "toner puffs", in turn, produce driving of toner particles into the surrounding air to cause contamination and dirty hands and clothing. The severest effects of "toner puffs" occur as the strip 67 is pulled away from the front end portion 78, since the strip curls up like a 'window shade' when parting from the cartridge, thus causing a shower of toner particles to spray on the operator's hands and sleeves. Between the ends 77, 78, the pulling force to remove the strip 67** is constant so that suddenness of force variations is not present or in prospect.

In the present invention, the pattern of adhesive material **70*a* at the end portions 77, 78 are formed in a curved line as shown, so that the strip removal pulling force at these ends is graduated. The patterns of adhesive material offer easy, graduated resistance to the pull force so as to avoid the sudden high peel force. The curved end portions 77, 78 are such that the ends of the curve blend into the ends of the material pattern on the sides of the opening 65**.

In the alternative, the portions 77, 78 may be defined by a pair of angled lines having thin apex extending outwardly away from the opening 65. The angles lines may also have their apex extending inwardly; however, with these patterns, the ends of the pattern of adhesive material along the sides of the opening 65 must extend further out toward the ends of the cartridge.

The cartridge 60 is also provided at its front end cap 79 with a "living handle" 80 which is hinged at 81, 82 to the material of the cap. If the material of the cap 79 is plastic, the hinges 81, 82 are made by reducing the amount of material along the hinges to permit pivoting motion. Tabs 83 formed along an edge of the material of the cap 79 cooperate with an edge 84 formed on a cutout 85 of the handle 80 to lock the handle within a recess 86 formed in the end cap. The bottom edge 87 of the handle 80 is angularly shaped and extends slightly below the bottom peripheral surface of the container 64 to prevent rolling action of the container when laid on a flat surface.

The container 64 may be made out of any suitable material, such as plastic material, derived from the blow mold process. This form of manufacture results in a single structural piece, with all parts made singularly from the same material. On the other hand, the body of the container may be made from paper in tube form and with end caps made of metal. The strip 67 is preferably made of impregnated paper which is coated with a layer of heat sensitive adhesive material. After a strip 67 has been placed upon the container covering the opening 65, a heated die having the shape of the pattern **70*a*, 70*b*, 77, 78 is applied to the top surface of the strip to effect adhesion of the strip on the container surface, as shown in FIG. 4**.

While the invention has been described to the structure disclosed, it is not confined to the details set forth, but is intended to cover such modifications or changes as may come within the scope of the following claims.

What is claimed is:

1. An apparatus for storing a supply of marking particles therein, including:

a container defining a chamber for storing the marking particles therein and having an elongated opening in the surface thereof extending substantially the length of said container for the discharge of the marking particles therefrom, said container is formed with a recess and includes a handle pivotally supported at said end and recessed in said recess when not in use;

a flexible sealing strip removably secured to said container sealing the opening in the surface thereof to prevent the discharge of the marking particles therefrom, said sealing strip being adapted for removal by a pulling force by an operator; and a layer of adhesive material applied between those portions of the container adjacent the entire edge of said opening and the adhering surface of said sealing strip applied thereto, said adhesive material being arranged at both ends of said opening wherein a gradual exerting force must be applied during removal of the strip at both of said ends, said ends defining a curve pattern.

2. The apparatus of claim 1 wherein the pattern of adhesive material at the portions of the container at the ends thereof comprises angularly related lines with the apex thereof extending outwardly from said opening.

3. The apparatus of claim 1 wherein the pattern of adhesive material at the portions of the container at the ends thereof comprises angularly related lines with the apex thereof extending inwardly toward said opening.

4. The apparatus of claim 1 wherein said handle includes releasably locking elements for holding the same in said recess.

* * * * *